US008530125B2

(12) United States Patent
Kurihara

(10) Patent No.: US 8,530,125 B2
(45) Date of Patent: Sep. 10, 2013

(54) DEVELOPER, DEVELOPER CONTAINER, AND IMAGE FORMING APPARATUS

(75) Inventor: Kazuteru Kurihara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 583 days.

(21) Appl. No.: 12/424,933

(22) Filed: Apr. 16, 2009

(65) Prior Publication Data

US 2009/0325097 A1 Dec. 31, 2009

(30) Foreign Application Priority Data

Jun. 25, 2008 (JP) ..... 2008-165196

(51) Int. Cl.
*G03G 9/087* (2006.01)

(52) U.S. Cl.
USPC ..... 430/108.1; 430/108.8; 430/109.1; 430/110.3

(58) Field of Classification Search
USPC ..... 430/110.1, 108.1, 108.8, 109.1
See application file for complete search history.

(56) References Cited

U.S. PATENT DOCUMENTS 5,204,208 A * 4/1993 Paine et al. ..... 430/137.12
5,281,502 A * 1/1994 Brewington et al. ..... 430/45.56
5,437,954 A * 8/1995 Saito ..... 430/108.6
5,688,626 A * 11/1997 Patel et al. ..... 430/137.14
5,780,191 A * 7/1998 Ide ..... 430/45.1
6,066,421 A * 5/2000 Julien et al. ..... 430/45.4
6,066,422 A * 5/2000 Blaszak et al. ..... 430/45.4
6,150,062 A * 11/2000 Sugizaki et al. ..... 430/45.55
6,627,372 B1 * 9/2003 Steinhauer et al. ..... 430/137.1
7,045,265 B2 * 5/2006 Horikoshi et al. ..... 430/108.6
2004/0152005 A1 * 8/2004 Ito et al. ..... 430/109.4
2004/0209015 A1 * 10/2004 Wickramanayake et al. ..... 428/32.31
2006/0084001 A1 * 4/2006 Nakanishi et al. ..... 430/109.4
2006/0084003 A1 * 4/2006 Shibai et al. ..... 430/110.4
2008/0292984 A1 * 11/2008 Moriyama ..... 430/109.4

FOREIGN PATENT DOCUMENTS

JP 08-194421 A 7/1996
JP 2008-083254 A 4/2008

* cited by examiner

*Primary Examiner* — Hoa V Le
(74) *Attorney, Agent, or Firm* — Marvin A. Motsenbocker; Mots Law, PLLC

(57) ABSTRACT

An aspect of the invention provides a developer that comprises first charged particles and second charged particles that have smaller charge than the first charged particles, or that are charged opposite to the first charged particles. Here, the first particles are colored, while the second particles may be colorless. Alternatively, the first particles are colored, while the second particles may have approximately the same color as a medium.

18 Claims, 11 Drawing Sheets

Fig.3

| | MOLD RELEASE AGENT (PARTS BY WEIGHT) | ELECTRIFICATION CONTROLLING AGENT I (PARTS BY WEIGHT) | ELECTRIFICATION CONTROLLING AGENT II (PARTS BY WEIGHT) | COLORANT (PARTS BY WEIGHT) | AVERAGE DIAMETER (μm) | AVERAGE ELECTRIFICATION AMOUNT (μC/g) | Tg (°C) | Tm (°C) |
|---|---|---|---|---|---|---|---|---|
| FIRST TONER | 5.0 | 1.0 | - | 4.0 | 6.5 | -25 | 66 | 115 |
| SECOND TONER A | 5.0 | 0.3 | - | - | 6.5 | -15 | 66 | 115 |
| SECOND TONER B | 5.0 | 0.3 | - | - | 7.0 | -14 | 66 | 115 |
| SECOND TONER C | 5.0 | 0.3 | - | - | 8.0 | -12 | 66 | 115 |
| SECOND TONER D | 5.0 | 0.3 | - | - | 6.0 | -16 | 66 | 115 |
| SECOND TONER E | 5.0 | 0.3 | - | - | 5.0 | -18 | 66 | 115 |
| SECOND TONER F | 5.0 | 1.0 | - | - | 6.5 | -21 | 66 | 115 |
| SECOND TONER G | 5.0 | 0.6 | - | - | 6.5 | -18 | 66 | 115 |
| SECOND TONER H | 5.0 | 0.1 | - | - | 6.5 | -10 | 66 | 115 |
| SECOND TONER I | 5.0 | - | 0.1 | - | 6.5 | 9 | 66 | 115 |
| SECOND TONER J | 5.0 | - | 0.3 | - | 6.5 | 13 | 66 | 115 |
| SECOND TONER K | 5.0 | - | 0.5 | - | 6.5 | 18 | 66 | 115 |

Fig.5

| | FIRST TONER (PARTS BY WEIGHT) | SECOND TONER (PARTS BY WEIGHT) | DENSITY | FOGGING | JUDGMENT RESULT |
|---|---|---|---|---|---|
| EXPERIMENT EXAMPLE 1 | 100 | 0 | 1.8 | 1.3 | POOR |
| EXPERIMENT EXAMPLE 2 | 95 | 5 | 1.7 | 0.6 | POOR |
| EXPERIMENT EXAMPLE 3 | 90 | 10 | 1.7 | 0.5 | FAIR |
| EXPERIMENT EXAMPLE 4 | 85 | 15 | 1.6 | 0.3 | FAVORABLE |
| EXPERIMENT EXAMPLE 5 | 80 | 20 | 1.6 | 0.2 | FAVORABLE |
| EXPERIMENT EXAMPLE 6 | 70 | 30 | 1.4 | 0.1 | FAVORABLE |
| EXPERIMENT EXAMPLE 7 | 60 | 40 | 1.3 | 0.1 | FAVORABLE |
| EXPERIMENT EXAMPLE 8 | 55 | 45 | 1.2 | 0.1 | FAVORABLE |
| EXPERIMENT EXAMPLE 9 | 50 | 50 | 1.1 | 0.1 | FAIR |
| EXPERIMENT EXAMPLE 10 | 40 | 60 | 1.0 | 0.1 | FAIR |
| EXPERIMENT EXAMPLE 11 | 30 | 70 | 0.7 | 0.1 | FAIR |
| EXPERIMENT EXAMPLE 12 | 20 | 80 | 0.4 | 0.1 | POOR |
| EXPERIMENT EXAMPLE 13 | 10 | 90 | 0.2 | 0.1 | POOR |
| EXPERIMENT EXAMPLE 14 | 0 | 100 | 0.0 | 0.0 | POOR |

Fig.6

| | MIXING RATIO (FIRST TONER : SECOND TONER) | FIRST TONER (μm) | SECOND TONER (μm) | DENSITY | FOGGING | JUDGMENT RESULT |
|---|---|---|---|---|---|---|
| EXPERIMENT EXAMPLE 15 | 85 : 15 | 6.5 | 5.0 | 1.2 | 0.2 | FAIR |
| EXPERIMENT EXAMPLE 16 | 85 : 15 | 6.5 | 6.0 | 1.3 | 0.2 | FAVORABLE |
| EXPERIMENT EXAMPLE 4 | 85 : 15 | 6.5 | 6.5 | 1.6 | 0.3 | FAVORABLE |
| EXPERIMENT EXAMPLE 17 | 85 : 15 | 6.5 | 7.0 | 1.6 | 0.4 | FAVORABLE |
| EXPERIMENT EXAMPLE 18 | 85 : 15 | 6.5 | 8.0 | 1.7 | 0.6 | FAIR |
| EXPERIMENT EXAMPLE 19 | 55 : 45 | 6.5 | 5.0 | 0.9 | 0.2 | FAIR |
| EXPERIMENT EXAMPLE 20 | 55 : 45 | 6.5 | 6.0 | 1.2 | 0.2 | FAVORABLE |
| EXPERIMENT EXAMPLE 8 | 55 : 45 | 6.5 | 6.5 | 1.2 | 0.1 | FAVORABLE |
| EXPERIMENT EXAMPLE 21 | 55 : 45 | 6.5 | 7.0 | 1.5 | 0.2 | FAVORABLE |
| EXPERIMENT EXAMPLE 22 | 55 : 45 | 6.5 | 8.0 | 1.7 | 0.6 | FAIR |

Fig.7

| | MIXING RATIO (FIRST TONER : SECOND TONER) | FIRST TONER (μC/g) | SECOND TONER (μC/g) | \| ⊿ \| (μC/g) | DENSITY | FOGGING | JUDGMENT RESULT |
|---|---|---|---|---|---|---|---|
| EXPERIMENT EXAMPLE 23 | 85 : 15 | -25 | -21 | 4 | 1.5 | 0.9 | FAIR |
| EXPERIMENT EXAMPLE 24 | 85 : 15 | -25 | -18 | 7 | 1.6 | 0.5 | FAIR |
| EXPERIMENT EXAMPLE 4 | 85 : 15 | -25 | -15 | 10 | 1.6 | 0.3 | FAVORABLE |
| EXPERIMENT EXAMPLE 25 | 85 : 15 | -25 | -10 | 15 | 1.5 | 0.3 | FAVORABLE |
| EXPERIMENT EXAMPLE 26 | 85 : 15 | -25 | 9 | 34 | 1.6 | 0.2 | FAVORABLE |
| EXPERIMENT EXAMPLE 27 | 85 : 15 | -25 | 13 | 38 | 1.5 | 0.2 | FAVORABLE |
| EXPERIMENT EXAMPLE 28 | 85 : 15 | -25 | 18 | 43 | 1.5 | 0.2 | FAVORABLE |
| EXPERIMENT EXAMPLE 29 | 55 : 45 | -25 | -21 | 4 | 1.2 | 0.7 | FAIR |
| EXPERIMENT EXAMPLE 30 | 55 : 45 | -25 | -18 | 7 | 1.2 | 0.6 | FAIR |
| EXPERIMENT EXAMPLE 8 | 55 : 45 | -25 | -15 | 10 | 1.2 | 0.1 | FAVORABLE |
| EXPERIMENT EXAMPLE 31 | 55 : 45 | -25 | -10 | 15 | 1.3 | 0.2 | FAVORABLE |
| EXPERIMENT EXAMPLE 32 | 55 : 45 | -25 | 9 | 34 | 1.4 | 0.1 | FAVORABLE |
| EXPERIMENT EXAMPLE 33 | 55 : 45 | -25 | 13 | 38 | 1.3 | 0.2 | FAVORABLE |
| EXPERIMENT EXAMPLE 34 | 55 : 45 | -25 | 18 | 43 | 1.4 | 0.2 | FAVORABLE |

Fig.8

| | MOLD RELEASE AGENT I (PARTSBY WEIGHT) | MOLD RELEASE AGENT II (PARTSBY WEIGHT) | MOLD RELEASE AGENT III (PP) | ELECTRIFICATION CONTROLLING AGENT I(PARTS BY WEIGHT) | COLORANT (PARTS BY WEIGHT) | AVERAGE DIAMETER (μm) | AVERAGE ELECTRIFICATION AMOUNT (μC/g) | Tg (°C) | Tm (°C) |
|---|---|---|---|---|---|---|---|---|---|
| SECOND TONER L | 2.0 | 0.0 | - | 0.3 | - | 6.5 | -14 | 71 | 115 |
| SECOND TONER M | 3.0 | 0.0 | - | 0.3 | - | 6.5 | -13 | 70 | 115 |
| SECOND TONER N | 4.0 | 0.0 | - | 0.3 | - | 6.5 | -15 | 66 | 115 |
| SECOND TONER A | 5.0 | 0.0 | - | 0.3 | - | 6.5 | -15 | 66 | 115 |
| SECOND TONER O | 4.0 | 1.0 | - | 0.3 | - | 6.5 | -13 | 66 | 115 |
| SECOND TONER P | 3.0 | 2.0 | - | 0.3 | - | 6.5 | -14 | 64 | 115 |
| SECOND TONER Q | 2.0 | 3.0 | - | 0.3 | - | 6.5 | -15 | 63 | 115 |
| SECOND TONER R | 1.0 | 4.0 | - | 0.3 | - | 6.5 | -16 | 60 | 115 |
| SECOND TONER S | 0.0 | 5.0 | - | 0.3 | - | 6.5 | -16 | 57 | 115 |
| SECOND PARTICLES | - | - | 100 | - | - | 6.5 | -8 | - | 124 |

Fig.9

| | MOLD RELEASE AGENT I (PARTSBY WEIGHT) | MOLD RELEASE AGENT II (PARTSBY WEIGHT) | MOLD RELEASE AGENT III (PP) | ELECTRIFICATION CONTROLLING AGENT I (PARTS BY WEIGHT) | COLORANT (PARTS BY WEIGHT) | AVERAGE DIAMETER (μm) | AVERAGE ELECTRIFICATION AMOUNT (μC/g) | Tg (°C) | Tm (°C) |
|---|---|---|---|---|---|---|---|---|---|
| THIRD TONER | 5.0 | 1.0 | - | 0.3 | - | 6.5 | -14 | 61 | 106 |
| FOURTH TONER | 5.0 | 0.0 | - | 0.3 | - | 6.5 | -13 | 70 | 110 |
| FIFTH TONER | 4.0 | 0.0 | - | 0.3 | - | 6.5 | -15 | 66 | 125 |
| SIXTH TONER | 3.0 | 0.0 | - | 0.3 | - | 6.5 | -15 | 66 | 140 |
| SEVENTH TONER | 2.0 | 0.0 | - | 0.3 | - | 6.5 | -13 | 66 | 142 |

Fig.10

| | MIXING RATIO (FIRST TONER : SECOND TONER) | FIRST PARTICLES | SECOND PARTICLES | FIXABILITY RATE (%) | KEEPING QUALITY | JUDGMENT RESULT |
|---|---|---|---|---|---|---|
| EXPERIMENT EXAMPLE 35 | 85 : 15 | FIRST TONER | SECOND TONER L | 89 | FAVORABLE | POOR |
| EXPERIMENT EXAMPLE 36 | 85 : 15 | FIRST TONER | SECOND TONER M | 90 | FAVORABLE | FAVORABLE |
| EXPERIMENT EXAMPLE 37 | 85 : 15 | FIRST TONER | SECOND TONER N | 92 | FAVORABLE | FAVORABLE |
| EXPERIMENT EXAMPLE 38 | 85 : 15 | FIRST TONER | SECOND TONER A | 93 | FAVORABLE | FAVORABLE |
| EXPERIMENT EXAMPLE 39 | 85 : 15 | FIRST TONER | SECOND TONER O | 94 | FAVORABLE | FAVORABLE |
| EXPERIMENT EXAMPLE 40 | 85 : 15 | FIRST TONER | SECOND TONER P | 94 | FAVORABLE | FAVORABLE |
| EXPERIMENT EXAMPLE 41 | 85 : 15 | FIRST TONER | SECOND TONER Q | 95 | FAVORABLE | EXCELLENT |
| EXPERIMENT EXAMPLE 42 | 85 : 15 | FIRST TONER | SECOND TONER R | 98 | FAVORABLE | EXCELLENT |
| EXPERIMENT EXAMPLE 43 | 85 : 15 | FIRST TONER | SECOND TONER S | 100 | POOR | POOR |
| EXPERIMENT EXAMPLE 44 | 85 : 15 | FIRST TONER | SECOND PARTICLES | 99 | FAVORABLE | EXCELLENT |
| EXPERIMENT EXAMPLE 45 | 55 : 45 | FIRST TONER | SECOND TONER L | 88 | FAVORABLE | POOR |
| EXPERIMENT EXAMPLE 46 | 55 : 45 | FIRST TONER | SECOND TONER M | 89 | FAVORABLE | POOR |
| EXPERIMENT EXAMPLE 47 | 55 : 45 | FIRST TONER | SECOND TONER N | 93 | FAVORABLE | FAVORABLE |
| EXPERIMENT EXAMPLE 48 | 55 : 45 | FIRST TONER | SECOND TONER A | 93 | FAVORABLE | FAVORABLE |
| EXPERIMENT EXAMPLE 49 | 55 : 45 | FIRST TONER | SECOND TONER O | 96 | FAVORABLE | EXCELLENT |
| EXPERIMENT EXAMPLE 50 | 55 : 45 | FIRST TONER | SECOND TONER P | 98 | FAVORABLE | EXCELLENT |
| EXPERIMENT EXAMPLE 51 | 55 : 45 | FIRST TONER | SECOND TONER Q | 99 | FAVORABLE | EXCELLENT |
| EXPERIMENT EXAMPLE 52 | 55 : 45 | FIRST TONER | SECOND TONER R | 100 | FAVORABLE | EXCELLENT |
| EXPERIMENT EXAMPLE 53 | 55 : 45 | FIRST TONER | SECOND TONER S | 100 | POOR | POOR |
| EXPERIMENT EXAMPLE 54 | 55 : 45 | FIRST TONER | SECOND PARTICLES | 99 | FAVORABLE | EXCELLENT |

Fig.11

| | MIXING RATIO (FIRST TONER : SECOND TONER) | FIRST PARTICLES | SECOND PARTICLES | FIXABILITY RATE (%) | KEEPING QUALITY | GLOSSINESS RATE (%) | JUDGMENT RESULT |
|---|---|---|---|---|---|---|---|
| EXPERIMENT EXAMPLE 55 | 85 : 15 | FIRST TONER | THIRD TONER | 94 | POOR | 28.9 | POOR |
| EXPERIMENT EXAMPLE 56 | 85 : 15 | FIRST TONER | FOURTH TONER | 93 | FAVORABLE | 15.9 | FAVORABLE |
| EXPERIMENT EXAMPLE 57 | 85 : 15 | FIRST TONER | FIFTH TONER | 92 | FAVORABLE | 7.6 | FAVORABLE |
| EXPERIMENT EXAMPLE 58 | 85 : 15 | FIRST TONER | SIXTH TONER | 91 | FAVORABLE | 5.9 | FAVORABLE |
| EXPERIMENT EXAMPLE 59 | 85 : 15 | FIRST TONER | SEVENTH TONER | 91 | FAVORABLE | 4.9 | POOR |
| EXPERIMENT EXAMPLE 60 | 55 : 45 | FIRST TONER | THIRD TONER | 97 | POOR | 32.1 | POOR |
| EXPERIMENT EXAMPLE 61 | 55 : 45 | FIRST TONER | FOURTH TONER | 95 | FAVORABLE | 22.5 | FAVORABLE |
| EXPERIMENT EXAMPLE 62 | 55 : 45 | FIRST TONER | FIFTH TONER | 91 | FAVORABLE | 11.6 | FAVORABLE |
| EXPERIMENT EXAMPLE 63 | 55 : 45 | FIRST TONER | SIXTH TONER | 91 | FAVORABLE | 5.1 | FAVORABLE |
| EXPERIMENT EXAMPLE 64 | 55 : 45 | FIRST TONER | SEVENTH TONER | 92 | FAVORABLE | 4.5 | POOR |

DEVELOPER, DEVELOPER CONTAINER, AND IMAGE FORMING APPARATUS

CROSS REFERENCE TO RELATED APPLICATIONS

This application claims priority based on 35 USC 119 from prior Japanese Patent Application No. P2008-165196 filed on Jun. 25, 2008, entitled "DEVELOPER, DEVELOPER CONTAINER, DEVELOPMENT APPARATUS, AND IMAGE FORMING APPARATUS", the entire contents of which are incorporated herein by reference.

BACKGROUND OF THE INVENTION

1. Field of the Invention

The invention relates to a developer, a developer container, and an image forming apparatus.

2. Description of Related Art

Electrophotographic image forming apparatus such as a printer, a copier or a facsimile machine generally form a toner image as follows: an charge device uniformly charges a surface of a photosensitive drum; an exposure device forms an electrostatic latent image by exposing the charged surface of the photosensitive drum; and a developing device develops the electrostatic latent image by adhering toner to the image. In this case, toner contained inside the developing device is frictionally charged to adhere to the electrostatic latent image.

SUMMARY OF THE INVENTION

An aspect of the invention provides a developer that comprises first charged particles and second charged particles that have smaller absolute value of charge than the first charged particles, or that are charged opposite to the first charged particles.

According to the developer above, the developer is a mixture of two different kinds of particles (first and second particles), and is formulated so that an absolute value of an charge amount of the second particles is smaller than that of the first particles, or the second particles are charged oppositely to the first particles. This makes it possible to prevent fogging (background) from occurring in an unprinted part of a medium, and, thus printing of an acceptable image.

BRIEF DESCRIPTION OF THE DRAWINGS

FIG. 3 is a table showing properties of toner in the first embodiment.

FIG. 5 is a first table showing experiment results in the first embodiment.

FIG. 6 is a second table showing experiment results in the first embodiment.

FIG. 7 is a third table showing experiment results in the first embodiment.

FIG. 8 is a first table showing properties of toner in a second embodiment.

FIG. 9 is a second table showing properties of toner in the second embodiment.

FIG. 10 is a first table showing experiment results in the second embodiment.

FIG. 11 is a second table showing experiment results in the second embodiment.

DETAILED DESCRIPTION OF EMBODIMENTS

Figure 1:
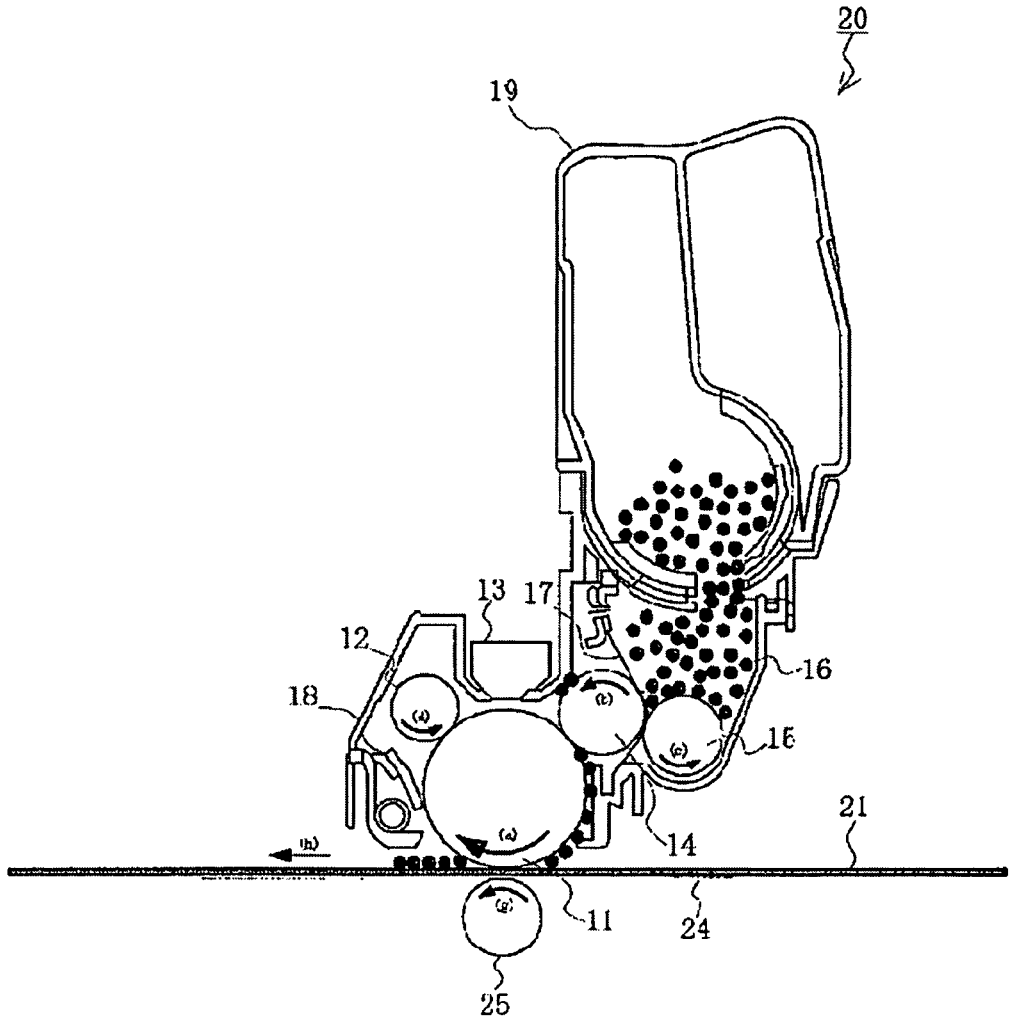
FIG. 1 is a view showing a configuration of a developing device in a first embodiment.

Embodiments are described below with reference to the drawings. In the respective drawings referenced herein, the same constituents are designated by the same reference numerals and duplicate explanation concerning the same constituents is basically omitted. All of the drawings are provided to illustrate the respective examples only. No dimensional proportions in the drawings shall impose a restriction on the embodiments. For this reason, specific dimensions and the like should be interpreted with the following descriptions taken into consideration. In addition, the drawings include parts whose dimensional relationship and ratios are different from one drawing to another.

Figure 2:
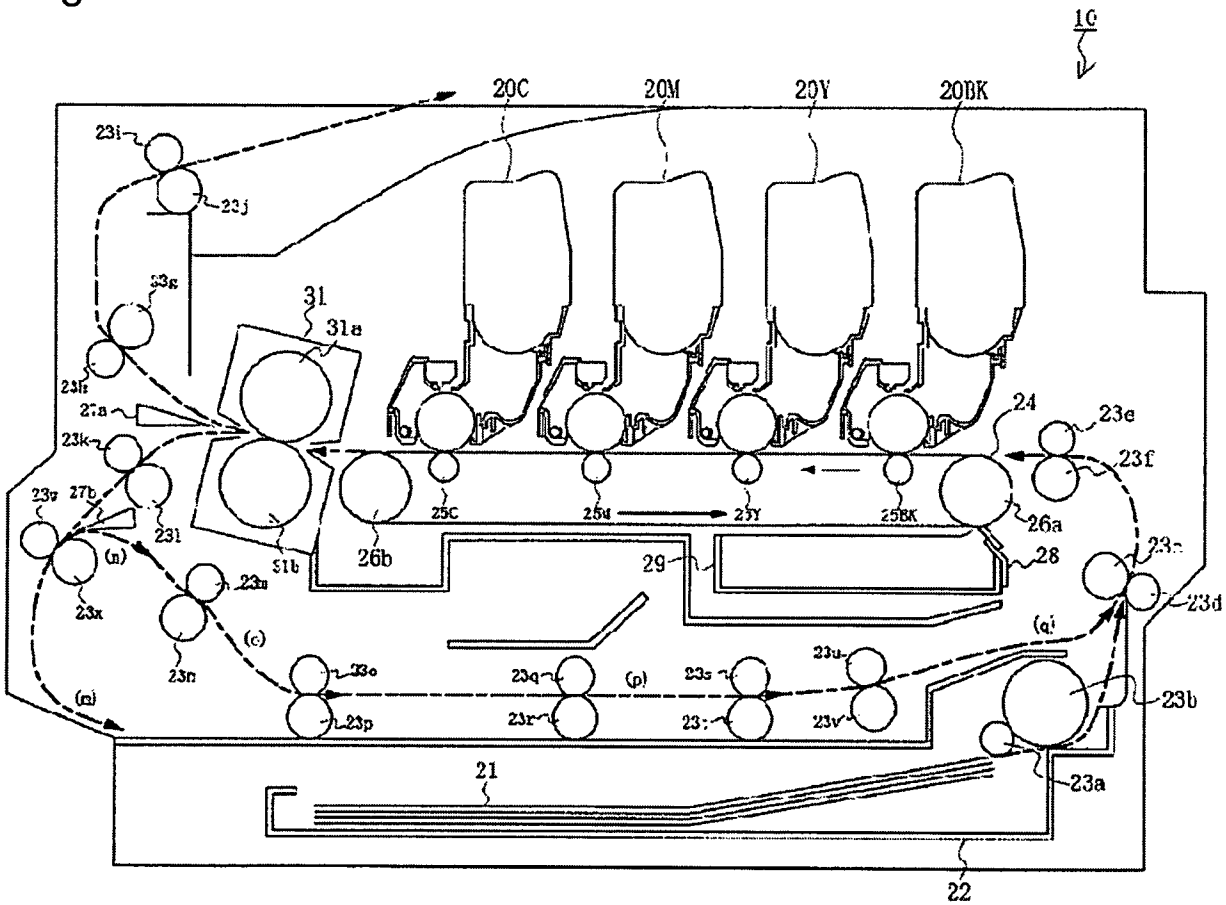
FIG. 2 is a schematic configuration view of an image forming apparatus in the first embodiment.

FIG. 2 is a schematic configuration view of an image forming apparatus in a first embodiment. Examples of image forming apparatus 10 include electrophotographic apparatus such as a printer, a copier, a facsimile machine, and a multi-function printer (MFP), which has the functions of a printer, a copier and a facsimile machine. However, image forming apparatus 10 is not limited to these, and may be an image forming apparatus of any type. In this embodiment, as an example of the image forming apparatus, an embodiment of a color electrophotographic printer of a so-called tandem system is described.

Inside image forming apparatus 10, developing devices 20BK, 20Y, 20M and 20C corresponding to four colors of black (BK), yellow (Y), magenta (M) and cyan (C), respectively, are arrayed along a transport path of medium 21 so as to be aligned in that order in a transport direction (from right to left in FIG. 2). Note that, configurations of developing devices 20BK, 20Y, 20M and 20C may be the same, and it is only necessary that colors of toner 16 contained therein as developers are different. When being described representatively, developing devices 20BK, 20Y, 20M and 20C may be described as developing devices 20 in some cases. Additionally, each of developing devices 20 may be installed inside image forming apparatus 10 as removable independent units, and is configured to form an image on medium 21 being transported along the transportation path.

Referring to FIG. 2, paper feed cassette 22 contains media 21 such as recording paper sheets. Transportation rollers 23*a* to 23*x* transport medium 21 fed from paper feed cassette 22. Reference numeral 24 indicates a transfer belt; reference numeral 26*a*, an idle roller; reference numeral 26*b*, a drive roller which is rotated by unillustrated driving means so as to drive transfer belt 24; and reference numerals 27*a* and 27*b*, movable medium-traveling guides that guide transported medium 21.

Medium 21 is transported as indicated by arrowed dotted lines in FIG. 2. Note that, paths (m) to (q) of the arrowed dotted lines indicate transport paths of medium 21 in a case where duplex printing is performed on medium 21. Alternatively, an arrowed solid line indicates a travel direction of transfer belt 24.

Additionally, transfer belt cleaning blade 28 removes untransferred toner 16 and foreign objects adhering to a surface of transfer belt 24. Waste developer tank 29 collects and contains toner and foreign objects removed from the surface of transfer belt 24 by transfer belt cleaning blade 28.

Furthermore, fixing unit 31 is a fixing device used to fix by heat and pressure a toner image transferred on medium 21, and includes heating roller 31*a* and pressure roller 31*b*. Note that heating roller 31*a* and pressure roller 31*b* are mainly made of aluminum, and have a hollow cylindrical metal core coated therearound with a thermally-resistant elastic layer of silicone rubber, and further coated therearound with a tetrafluoroethylene-perfluoroalkyl vinyl ether copolymer (PFA) tube. Additionally, heating roller 31*a* has an unillustrated heater formed of a halogen lamp or the like inside the metal core. Moreover, a pressure-contact portion is formed between heating roller 31*a* and pressure roller 31*b*. Furthermore, an unillustrated thermistor, serving as a surface temperature detector for heating roller 31*a*, is arranged near heating roller 31*a* while out of contact with heating roller 31*a*.

Additionally, reference numerals 25BK, 25Y, 25M and 25C indicate transfer rollers arranged so as to face developing devices 20BK, 20Y, 20M and 20C which form toner powder images, i.e., toner images, of black, yellow, magenta and cyan colors, respectively. Each of these rollers is a roller obtained by coating a metal shaft with a urethane sponge layer. Note that, when being described representatively, transfer rollers 25BK, 25Y, 25M and 25C are described as transfer rollers 25.

Next, a configuration of developing device 20 is described in detail. FIG. 1 is a view showing a configuration of a developing device in the first embodiment. Photosensitive drum 11 serving as an image carrier includes: a conductive support member formed of an aluminum metal tube; and a photoconductive layer coated thereon, which is an organic photosensitive member obtained by sequentially coating an electric charge generation layer and an electric charge transport layer. Photosensitive drum 11 has an unillustrated driving gear arranged therein. Additionally, charge roller 12 serving as a charge device is obtained by coating a metal shaft with a semiconductive epichlorohydrine rubber layer. Furthermore, light emitting diode (LED) head 13 serving as an exposure device is arranged so as to face photosensitive drum 11.

Developing roller 14 serving as a developer carrier is obtained by covering a metal shaft with a semiconductive urethane rubber layer, and has unillustrated driving gear arranged therein. Additionally, toner supply roller 15 serving as a developer supplying rotating member is obtained by covering a metal shaft with a semiconductive foam-forming silicone sponge layer.

Developing device 20 includes: developing blade 17 made of stainless steel serving as a developer metering member; cleaning blade 18 made of urethane rubber serving as a developer collector; and toner cartridge 19 serving as a developer container which contains toner 16.

Here, toner 16 serving as a developer includes a polyester resin as a binder resin. Toner 16 includes a charge controlling agent, a release agent, a colorant and the like as internal additives, and additionally includes silica and the like as external additives.

Note that photosensitive drum 11, charge roller 12, developing roller 14, toner supply roller 15 and transfer roller 25 rotate in directions indicated by arrows (a) to (d) and (g) in FIG. 1. Thereby, a toner image formed on the surface of photosensitive drum 11 is transferred by transfer belt 24 onto medium 21 which is being transported in a direction indicated by an arrow (h).

Next, toner 16 is described in detail. FIG. 3 is a table showing properties of toner in the first embodiment. In FIG. 3 mixture component ratios are shown relative to 100 parts by weight (pbw) of a binder resin (a polyester resin having a number average molecular weight (Mn) of 3700, and a glass transition temperature (Tg) of 62° C.).

In this case, carnauba wax (Powdered Carnauba Wax No. 1 manufactured by S. Kato & Co.) is used as a mold release agent, Pigment Blue 15.3 "ECB-301" (manufactured by Dainichiseika Color & Chemicals Mfg. Co., Ltd.) is used as a colorant, a salicylate complex "Bontron E-84" (manufactured by Orient Chemical Industries, Ltd.) is used as a charge controlling agent I for negative charge, and quaternary ammonium salt "Bontron P-51" (manufactured by Orient Chemical Industries, Ltd.) is used as a charge controlling agent II for positive charge.

After being mixed by use of a Henshell mixer (manufactured by Mitsui Mitsuike Chemical Plants Co. Ltd.), these materials are melted and kneaded by a twin-screw extruder, and then, are cooled. Thereafter, the materials are coarsely ground by a cutter mill having a screen whose diameter is 2 mm, are more finely ground by use of an impact crusher "Dispersion Separator" (manufactured by Nippon Pneumatic Mfg, Co., Ltd.), and are then classified by use of a wind classifier. Thereby, fine particles, which become mother particles, are obtained.

Subsequently, as an external addition process, 2.5 pbw of hydrophobic silica R972 (manufactured by Nippon Aerosil Co., Ltd., and having an average primary particle diameter of 16 nm) is added to 100 pbw of the resulting fine ground particles. Then, the particles are agitated by a 100-liter capacity Henshell mixer for 5 minutes at a rotation speed of 3200 rotations per minute, and are left to stand to be cooled. The particles are again agitated by the Henshell mixer for 5 minutes at a rotation speed of 3200 rotations per minute, and are cooled. This agitating and cooling process is repeated five times (such that a total agitation time with the mixer being rotated is 25 minutes), whereby there are obtained: first toner which is first particles provided as a colored developer; and second toners A to K which are second particles as colorless and transparent developers.

An average charge amount of each of the first toner and second toners A to K is found by measuring charge amounts thereof by use of a suction-type charge amount measurement apparatus "Mode 1210HS-2A" (manufactured by Trek Inc.) after 0.6 g of the toner and 19.4 g of a silicon-coated ferrite carrier "FL961-1025" (manufactured by Powdertech Co., Ltd.) are agitated by a ball mill for 10 minutes.

Additionally, a volume average particle diameter of each of the first toner and second toners A to K is found by using a cell count analyzer "Coulter Multisizer 3" (manufactured by Beckman Coulter Inc.), and measuring particles for 30,000 counts with an aperture diameter set to 100 μm.

Furthermore, a glass transition temperature, Tg, of each toner is found by setting a temperature elevation speed of a differential scanning calorimeter "DSC-7" (manufactured by PerkinElmer, Inc.) to 80° C. per minute, and measuring the glass transition temperature while heating 10 milligrams of the toner.

Thus, measurement values of the above respective properties of the first toner and second toners A to K is obtained as shown in FIG. 3.

Referring to FIG. 1 and FIG. 2, operation of image forming apparatus 10 is described. Photosensitive drum 11 is driven by an unillustrated drive motor through the driving gear, whereby photosensitive drum 11 is rotated in the direction indicated by the arrow (a). Then, charge roller 12 making contact with photosensitive drum 11 is rotated in the direction indicated by the arrow (d). Then, an electrostatic latent image is formed on the surface of the rotating sensitive drum 11 by LED head 13. Note that a laser exposure apparatus or the like can be used in place of LED head 13.

Additionally, with developing roller 14 arranged in contact with photosensitive drum 11, rotation of the unillustrated driving motor is transmitted thereto through the driving gear. Thereby, developing roller 14 is rotated in the direction indicated by the arrow (b) so that a speed of developing roller 14 can be faster than photosensitive drum 11. Thereby, developing roller 14 conveys, to a development region, toner 16 contained in toner cartridge 19, and transfers toner 16 to the electrostatic latent image formed on the surface of photosensitive drum 11. In this manner, developing roller 14 converts the electrostatic latent image into a visible toner image. Note that a speed relative to photosensitive drum 11, and a rotational direction, of developing roller 14 can be changed as appropriate.

Toner supply roller 15, which can be arranged in, or out of, contact with developing roller 14, is also rotatably driven by the driving motor through the driving gear. Thereby, toner supply roller 15 is rotated in the direction indicated by the arrow (c), and supplies toner 16 to developing roller 14. Additionally, developing blade 17 meters a thin layer of toner 16 to developing roller 14 from toner supply roller 15.

Transfer roller 25, arranged in contact with photosensitive drum 11, is also rotatably driven by the unillustrated driving motor through the driving gear. Thereby, transfer roller 25 is rotated in the direction indicated by the arrow (g). Additionally, a voltage is applied to transfer roller 25 by an unillustrated power supply, whereby the toner image on the surface of photosensitive drum 11 is transferred to medium 21, such as a sheet of paper or an OHP sheet, which is transported in the direction indicated by the arrow (h).

After the toner image is transferred to medium 21 cleaning blade 18 removes any toner 16 remaining on photosensitive drum 11.

Fixing unit 31 fixes the transferred toner image on medium 21. In this case, while heating roller 31*a* and pressure roller 31*b* inside the fixing unit 31 rotate, a surface of heating roller 31*a* is heated by the heater supplied with power from the unillustrated power supply, and toner 16 of the toner image transferred on to medium 21 is heated. Then, melted toner 16 is pressed against medium 21 by heating roller 31*a* and pressure roller 31*b*.

Note that, fixation unit 31 is not necessarily limited to the roller-type device in this embodiment, and a belt-type device using a belt, a film-type device using a film, a flash-type device utilizing luminescence energy, or the like can be employed as fixation unit 31. In the roller-type or belt-type device, oil is fed to the heating roller, the belt or the like through an oil feeding process including an oil feeding mechanism such as an oil supply roller, an oil feeding sheet or an oil tank, whereby hot offset is prevented. Additionally, the oil is not necessarily a particular material, but oil relatively low in viscosity among silicone oil, mineral oil and the like is used as the above oil in general.

Furthermore, as shown in the embodiment, occurrence of hot offset can be also be prevented by an oilless process.

Figure 4:
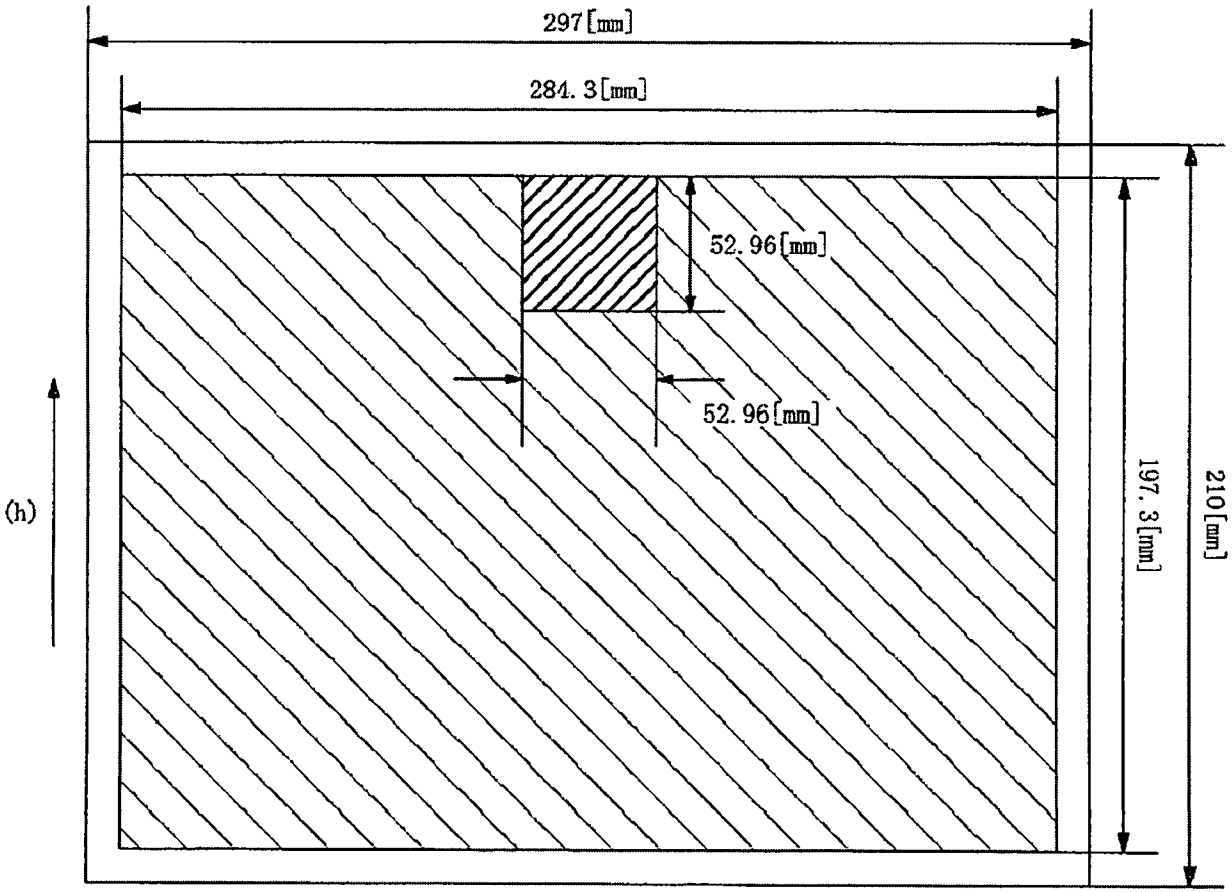
FIG. 4 is a view showing a print pattern in the first embodiment.

Next, experiment examples in the embodiment are described. FIG. 4 is a view showing a print pattern in the first embodiment; FIG. 5, a first table showing experiment results in the first embodiment; FIG. 6, a second table showing experiment results in the first embodiment; and FIG. 7, a third table showing experiment results in the first embodiment.

Mixtures of second toner A with the first toner were prepared at varying ratios so that the resultant mixture was 100 (pbw). Note that the Henshell mixer is used to mix the first toner and second toner A. The data in FIG. 5 represents assessment of various properties of these toner mixtures. The mixture is performed at a rotation speed of 1000 rpm for 90 seconds. Subsequently, 150 g of toner 16 obtained by mixing the first toner and second toner A is filled into toner cartridge 19, and printing is performed with toner cartridge 19 installed in image forming apparatus 10.

In this case, a printing speed (equal to a linear speed of the photosensitive drum, and to a paper feeding speed) is set to 200 mm per second. A print pattern shown in FIG. 4 is printed on paper sheets that are size of standard A4 (for example, a sheet of OKI Excellent White weighing 80 g/m$^2$) with 5% coverage (100% coverage means that a percentage of a solid black area to a printable area of one sheet paper that is size of A4 is 100%) and with the sheets set in a landscape orientation (where the longer two sides of the four sides of each paper sheet are set as front and rear ends). Mixed toner 16 is adjusted to be formed into a layer having a density of 0.6 mg/cm$^2$ on photosensitive drum 11. Adjustment is made by adjusting a bias voltage of an unillustrated power supply.

The assessment is performed based on image densities printed on media 21, and fogging (background) in an unprinted part. Note that, for the image densities, printed images are measured by a spectral densitometer "X-Rite 528" (manufactured by X-Rite Co., with a C light source, a viewing angle of 2°, and a response E mode).

Additionally, with respect to the fogging, solid white is printed on standard A4 paper sheets by transmitting, to image forming apparatus 10, print data having no image. Then, a power supply of image forming apparatus 10 is turned off while medium 21 is passing through photosensitive drum 11, whereby the apparatus is forced to stop. In this condition, toner 16 remaining on photosensitive drum 11 is stripped off by use of "Scotch Tape" (manufactured by Sumitomo 3M Ltd.); both a piece of Scotch Tape on which toner 16 adheres and an unused piece of Scotch Tape are attached on the same piece of paper; a color difference ΔE*ab in a L*a*b* color specification system is measured for the attached pieces of Scotch Tape by use of a spectral colorimeter "CM-2600d" (manufactured by Konica Minolta Sensing, Inc.).

Note that judgment criteria are set to: 1.2 or higher as a favorable range of image densities; and lower than 0.5 as a favorable range of fogging.

In FIG. 5, the experiment results for Experiment Examples 1 to 14 are shown. The experiment results are categorized three criteria, which are: favorable when the image density and the fogging are both favorable; fair when one of the image density and the fogging is favorable; and poor when none of the image density and the fogging is favorable. As shown in FIG. 5, in cases where second toner A, which is lower in charge amount than the first toner, is mixed into the first toner, the addition of relatively small amounts of second toner A improves fogging. Moreover, a very favorable image quality is obtained by mixing second toner A so as to account for 15 (pbw) or more. However, when second toner A is mixed so as to account for 45 (pbw) or more, an adverse effect occurs such that lower proportions of the first toner of the entire toner 16 results in reduced image densities.

In this way, fogging is improved and a favorable image is obtained by adjusting mixing proportions of the first toner and the second toner to appropriate values.

Next, assessment is performed on the first toner and second toners A to E whose average diameters are varied. In this case, mixing ratios (the first toner: the second toner) are set to the same as the mixing ratios of Experiment Example 4 (where each of second toners A to E accounts for 15 (pbw)) and Experiment Example 8 (where each of second toners A to E accounts for 45 (pbw)), which are on borders where the judgment is changed from "fair" to "favorable" in assessment of the experiment examples shown in FIG. 5.

In FIG. 6, the experiment results for Experiment Examples 4 and 8 described above, and Experiment Examples 15 to 22 are shown. The experiment results are categorized three criteria, which are: favorable when the image density and the fogging are both favorable; fair when one of the image density and the fogging is favorable; and poor when none of the image density and the fogging is favorable. As shown in FIG. 6, in both cases where each of second toners A to E accounts for 15 (pbw), and where each of second toners A to E accounts for 45 (pbw), the larger the average diameters of second toners A to E, the higher the image densities become, and the less fogging is found to be improved. This is attributable to the fact that, as a chance of contact between the first toner and each of second toners A to E is smaller, the first toner failed to assume appropriate charge.

On the other hand, in cases where second toners A to E have smaller average diameters, the image densities are lower. This is because, although chances of contact thereof with the first toner are larger, it is easier for second toners A to E having smaller average diameters to pass through developing blade 17. Accordingly, it is desirable that the second toner having substantially the same average diameter as the first toner be mixed with the first toner.

Furthermore, comparable assessment is performed with charge amounts of the second toner being varied. In this case, mixing ratios are set with the second toner accounting for 15 (pbw) and accounting for 45 (pbw). Toner used in the assessment is the first toner, and second toner A as well as second toners F to K.

In FIG. 7, the experiment results for Experiment Example 4 and 8 described above, and Experiment Examples 23 to 34 are shown. The experiment results are categorized three criteria, which are: favorable when the image density and the fogging are both favorable; fair when one of the image density and the fogging is favorable; and poor when none of the image density and the fogging is favorable. As shown in FIG. 7, in both cases where each of second toners A to E accounts for 15 (pbw), and where each of second toners A to E accounts for 45 (pbw), fogging is not found to be improved when an absolute value $|\Delta|$ of a difference between charge amounts of the first toner and the second toner is less than 10 μC/g. The believed reason for this is that, as charge tendencies of particles of the first toner and the second toner are close, a lower rate of the second toner becomes fogging toner. For this reason, $|\Delta|$ is preferably 10 μC/g or more.

Thus, in the first embodiment, particles of the second toner serving as the colorless and transparent developer are mixed with the first toner that serves as a colored developer. Here, the particles of the second toner are the second particles configured such that an absolute value of an charge amount thereof is smaller than that of the first particles, or that the second particles are charged oppositely to the first particles. In this way, fogging does not appear in an unprinted part, and thus a favorable image can be obtained.

Note that, the second particles are configured to be colorless and transparent in the embodiment, however, if a color of medium 21 printed by image forming apparatus 10 is known in advance, it is possible to prevent fogging from occurring in an unprinted part of medium 21 by configuring such that the second particles have substantially the same color as medium 21.

Next, a second embodiment is described. Note that, components having the same configurations as those of the first embodiment are denoted by the same reference numerals, and thus description thereof is omitted. Additionally, description of the same operations and effects as those of the first embodiment is also omitted.

FIG. 8 is a first table showing properties of toner in a second embodiment; and FIG. 9, a second table showing properties of toner in the second embodiment.

In the first embodiment, although the second toner does not appear in a manner affecting printing quality, numerous particles of the second toner actually exist on a recoding medium. For this reason, the second toner existing as fogging is proactively utilized in this embodiment.

Second toners L to N are produced in the following manner. In the production process of toner 16 which is described in the first embodiment, amounts of the carnauba wax used as a mold release agent are reduced respectively to allow glass transition temperatures Tg of the respective second toners to be varied. Additionally, second toners O to S are produced in the same manner as in the first embodiment except that the carnauba wax serving as a mold release agent I and paraffin wax "Paraffin Wax 130" (manufactured by Nippon Seiro Co., Ltd., having a melting point of 55° C.) serving as a mold release agent II are mixed to be used therein.

Furthermore, in place of the second toner, an alternative for the second toner is prepared, as the second particles, by melting polypropylene "NP-056" (manufactured by Mitsui Chemicals Inc., hereinafter abbreviated as "PP") as a mold release agent III, and then, grinding and classifying the melted polypropylene so resulting particles have substantially the same diameters as the first toner.

In FIG. 8, measurement results of average diameters (μm), average charge amounts (μC/g), glass transition temperatures Tg (° C.) and melting points Tm (° C.) of second toners L to S and the second particles are shown.

Furthermore, third, fourth and fifth toner are produced as binder resins (each being a polyester resin, having a number average molecular weight Mn of 4000, and a glass transition temperature Tg of 62° C.) in order to vary melting points of the particles. Measurement results of average diameters, average charge amounts, glass transition temperatures Tg and melting points Tm of the thus produced toner are shown in FIG. 9. When the mold release agent I added to the second toner is increased in amount, a melting point of each of the binder resins decreases due to compatibility between the binder resin and the mold release agent I, whereby the melting points Tm of the toner are decreased.

Next, experiment examples in the embodiment are described. FIG. 10 is a first table showing experiment results in the second embodiment; and FIG. 11, a second table showing experiment results in the second embodiment.

First, an assessment method in the embodiment is described in detail. Assessment is performed as to: whether or not toner 16 is melted and fixed when being left to stand under a high temperature and high humidity condition, that is, keeping quality; whether or not toner 16 is fixed on medium 21 when temperatures of fixation unit 31 inside image forming apparatus 10 are varied, that is, fixability; and a light reflectance of a printed image, that is, glossiness.

In the assessment as to the keeping quality, 10 g of toner 16 is filled into an aluminum cylinder whose inner diameter f is 30 mm, is subjected to a load of 20 g on the top thereof, and is left for forty eight (48) hours to stand under a high temperature and high humidity condition where a temperature is 50° C., and a humidity is 55%. Then, the cylinder is slowly removed, and then, if toner 16 fixed into a cylindrical shape, toner 16 is assessed as poor, and if not, toner 16 is assessed as favorable.

Additionally, in the assessment as to the fixability, a fixation rate (%) defined by equation (1) shown below is used.

$$\text{Fixation rate (\%)} = (\text{density after stripping}/\text{density before stripping}) \times 100 \quad (1)$$

Here, the density before stripping is a value obtained by measuring an image-printed portion by using X-Rite 528. In contrast, the density after stripping is an image density measured as follows: a piece of Scotch Tape is attached on an image-printed part; a load of 50 g/cm$^2$ is applied once to the piece of Scotch Tape at a reciprocating speed of 10 mm/sec; then, the piece of Scotch Tape is detached from the image-printed part; thus, the image density remaining on the image-printed part is measured.

Assessment criteria in this case are: excellent when the fixation rate is 95% or higher; favorable when the fixation rate is not less than 90% and less than 95%; and poor when the fixation rate is less than 90%. As to the glossiness, an image-printed part is measured by use of Murakami Color Research Laboratory Gloss Meter (Type GM-26D, with a viewing angle of 75°), and is assessed as favorable when the glossiness is not less than 5%. Additionally, the image forming apparatus 10 used in the experiments is MICROLINE 9800 (manufactured by Oki Data Co., Ltd.).

The experiment results with results for Experiment Examples 35 to 54 are shown in FIG. 10, and the experiment results with results for Experiment Examples 55 to 64 are shown in FIG. 11.

As shown in FIGS. 10 and 11, when a difference in Tg between the first toner and the second toner is 3° C. or more, very favorable fixability is obtained. Accordingly, it can be found that a difference in Tg between the first toner and the second toner is preferably 3° C. or more, in order to provide the second toner with a function of enhancing fixability. Additionally, favorable fixability is obtained in toner 16 in which polypropylene is mixed as the second particles. Furthermore, in cases where the third to seventh toner shown in FIG. 9 are used, toner favorable both in keeping quality and in glossiness is obtained when melting points of the second particles are 110 to 140° C., and the glossiness can be changed by changing mixing ratios of the first and second particles.

Herein, the glossiness is set changeable depending on mixing ratios of the first and second particles. However, the glossiness can be set changeable by controlling an amount of fogging of the second particles through the control of voltages applied to photosensitive drum 11, developing roller 14, supply roller 15 and developing blade 17.

In this embodiment, favorable toner 16 is obtained with a low-temperature fixing property by adding a mold-releasing function to the second toner and the second particles.

Note that, although an example where image forming apparatus 10 is a printer, the invention can also be applied to an MFP, a facsimile machine, and a copier.

As described above, according to the developer, developer container and image forming apparatus of the invention, the developer having particles of two kinds (first and second particles) mixed with each other is configured such that an absolute value of an charge amount of the second particles is smaller than that of the first particles, or that the second particles are charged oppositely to the first particles. This makes it possible to prevent fogging from occurring in an unprinted part of a medium, and thus to form a favorable image.

The invention includes embodiments other than those described in the above embodiments as long as these other embodiments do not depart from the spirit of the invention. The described embodiments are provided only for the purpose of describing the invention, and are not intended to limit the scope of the invention. The scope of the invention is defined by descriptions in the claims, and is not defined by descriptions in the description. Accordingly, the invention includes all forms having implications and ranges within the equivalent scope of the claims.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A developer comprising:

first charged particles comprising binder resin, charge control agent and colorant; and second charged particles comprising binder resin, and charge control agent that are charged opposite to the first charged particles, wherein the first charged particles and the second charged particles are mixed with each other, wherein both the first charged particles and the second charged particles are capable of becoming frictionally charged to adhere to an electrostatic latent image on an image carrier, and wherein an absolute value of a difference between charge amounts of the first charged particles and the second charged particles is not less than 10 μC/g.

2. The developer of claim 1, wherein the first charged particles are colored, and the second charged particles are colorless.

3. The developer of claim 1, wherein the first charged particles are colored, and the second charged particles have approximately the same color as a medium.

4. The developer of claim 1, wherein a mixing ratio of the first charged particles to the second charged particles is in the range 85:15 to 55:45.

5. The developer of claim 1, wherein the first charged particles and the second charged particles have approximately the same particle diameters.

6. The developer of claim 1, wherein the second charged particles have a lower glass transition temperature than the first charged particles.

7. The developer of claim 1, wherein the glass transition temperatures of the first charged particles and of the second charged particles are in the range 60 to 70° C., and the difference between the glass transition temperatures of the first charged particles and the second charged particles is not less than 3° C.

8. The developer of claim 1, wherein the second charged particles have a higher melting point than the first charged particles.

9. The developer of claim 1, wherein the melting points of the first charged particles and the second charged particles are in the range 110 to 140° C.

10. The developer of claim 1, wherein the second charged particles are a mould release agent.

11. A developer container comprising the developer of claim 1.

12. An image forming apparatus comprising a developer container comprising the developer of claim 1.

13. The developer of claim 1, wherein the second charged particles have an appreciably smaller absolute value of charge than the first charged particles.

14. The developer of claim 1, wherein the first charged particles are colored particles comprising a colorant, an electrification control agent and a mold release agent; and the second charged particles are colorless particles comprising an electrification control agent and a mold release agent.

15. A developer comprising:

first charged particles comprising binder resin and colorant; and second charged particles comprising binder resin, wherein the first charged particles and the second charged particles are of approximately the same size and binder resin composition and are capable of becoming frictionally charged to adhere to an electrostatic latent image on an image carrier, wherein the second charged particles are charged opposite to the first charged particles, wherein both the first charged particles and the second charged particles compete for binding to the image carrier such that fogging in an unprinted part of a medium is minimized when using a mixture of the first charged particles and the second charged particles, and wherein an absolute value of a charge amount of the second particles is within a first range of values that is different than an absolute value of a charge amount of the first particles that is within a second range of values.

16. The developer of claim 15, wherein the second charged particles lack colorant.

17. The developer of claim 1, where the first charged particles and the second charged particles comprise the same type of binder resin.

18. The developer of claim 15, where the first charged particles and the second charged particles comprise the same type of binder resin.

* * * * *